United States Patent [19]

Follows et al.

[11] 4,076,289

[45] Feb. 28, 1978

[54] LOCK FOR A SLIDABLE DOOR

[75] Inventors: James Samuel Follows; Gerhard Stanley Bergen, both of Surrey, Canada

[73] Assignee: Vanguard Plastics Ltd., Canada

[21] Appl. No.: 725,517

[22] Filed: Sep. 22, 1976

[51] Int. Cl.[2] ..... E05C 3/08

[52] U.S. Cl. ..... 292/226

[58] Field of Search ..... 292/DIG. 46, DIG. 49, 292/101, 103, 106, 126, 128, 356, 226

[56] References Cited

U.S. PATENT DOCUMENTS

| | | | |
|---|---|---|---|
| 1,002,259 | 9/1911 | Goedeke | 292/DIG. 40 |
| 1,580,666 | 4/1926 | Hansen | 292/DIG. 49 |
| 3,025,693 | 3/1962 | Braginety | 292/DIG. 46 |
| 3,162,472 | 12/1964 | Rust | 292/114 |

*Primary Examiner*—Richard E. Moore

*Attorney, Agent, or Firm*—Fulwider, Patton, Rieber, Lee & Utecht

[57] ABSTRACT

A lock for a slidable door. The lock comprises an elongate body formed with an open catch compartment. A back plate closes the catch compartment. There is a catch opening in a first side wall of the catch compartment. A pivotable hub is borne by aligned bearing means in the back plate of the catch compartment. A catch is mounted on the hub and is reciprocable with the hub between a lock position from which the catch projects through the catch opening and an unlocked position in which the catch is within the catch compartment. The lock has means to permit selection of the lock or unlock position of the catch and means to maintain the catch in the selected position.

10 Claims, 9 Drawing Figures

18
2
16
33
50
26
28
30
34
24
78
84
80
38
86
60
76
54
74
52
58
36
46
64
72
88
56
82
26
28
50
22
44
68
66
62
90
33
14
42
20
40
18
46

LOCK FOR A SLIDABLE DOOR

BACKGROUND OF THE INVENTION

1. Field of the Invention

This invention relates to a lock for a slidable door.

2. Description of the Prior Art

A wide variety of locks for slidable doors are known. In these locks it is the usual practice to provide a separate cartridge in which the catch is mounted. Thus the prior art locks traditionally comprise a body mounted around a catch cartridge attached by conventional means to the body and a handle.

Usually these prior art locks must be made of metal to impart the necessary rigidity to them.

SUMMARY OF THE INVENTION

The present invention seeks to provide a lock in which the catch compartment is formed integrally and in which the lock has a greater rigidity than in the prior art. In its preferred embodiments the invention provides locks of such intrinsic rigidity that a substantial portion of each lock, and in particular, the majority of the body of the lock may be made of a resin, for example polycarbonate.

According the present invention is a lock for a slidable door comprising an elongate body formed with an open catch compartment, a back plate to close the catch compartment, a catch opening in a first side wall of the catch compartment, a pivotable hub borne by aligned bearing means in the back plate and the catch compartment, a catch mounted on the hub and reciprocable with the hub between a lock position in which the catch projects through said catch opening and an unlocked position in which the catch is within said catch compartment, means to permit selection of the lock or unlock position of the catch and means to maintain the catch in the selected position.

DESCRIPTION OF THE PREFERRED EMBODIMENTS

Figure 1:
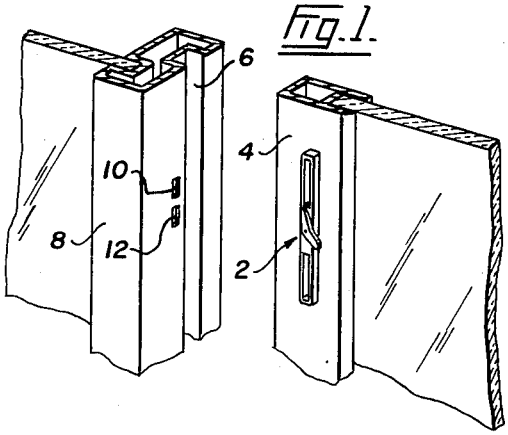
FIG. 1 illustrates an embodiment of the invention in position on a slidable door.
Figure 5:
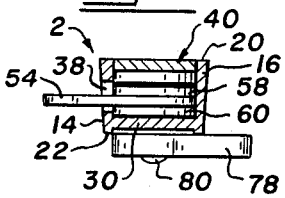
FIG. 5 is a section along the line 5—5 of FIG. 3.

FIG. 1 illustrates a lock indicated generally as 2 in position on the stile 4 of a door that is partially illustrated. The stile 4 engages in a channel 6 in a jamb 8. When the stile 4 engages in the channel 6 the catch (not shown in FIG. 1 but illustrated in the other drawings), of the lock 2 engages in an aperture 10 in the jamb 8. An anti-lift device (not shown in FIG. 1 but shown in the other Figures) engages in the aperture 12 in the jamb 8. These anti-lift devices are well known in the art. Their function is to prevent the catch, which is usually spring loaded, being moved out of the locked position by lifting the door. The anti-lift device is not spring loaded but fixed and resists such lifting.

FIGS. 2 to 6 illustrate an embodiment of a lock according to the invention in more detail. In the drawings the lock, generally designated as 2 in FIG. 1, comprises an elongate body having a first side wall 14 and a second side wall 16. There are end walls 18 and the walls 14, 16 and 18 define a door- or wall-contacting base 20 and a top 22 for the elongate body. A catch compartment 24 (see FIGS. 3 and 6) is formed by cross walls 26 spaced from the end walls 18 and joining the first side wall 14 and the second side wall 16. The cross wall 26 stops short by the amount 28 (see FIGS. 4 and 6) of the base 20 of the lock. An upper wall 30 adjacent the top 22 of the elongate body, forms the top of the catch compartment 24. Finger recesses 32 are formed on each side of the catch compartment 24 between side walls 14 and 16, end wall 18 and cross wall 26. These recesses are provided with a floor 33.

A circular aperture 34 (see FIG. 6) is formed in the upper wall 30 of the catch compartment 24. A first aperture 36 and a second aperture 38 are formed in the first side wall 14 in the catch compartment 24.

The lock has a back plate 40 for the catch compartment 24. The back plate 40 abuts the cross walls 26 of the catch compartment and is substantially flush with the base 20 of the elongate body. Back plate 40 has an anti-lift plate 42 formed integrally. The anti-lift plate 42 extends through the first aperture 36 in the first side wall 14. The back plate 40 is also formed with a substantially circular aperture 44, axially aligned with the aperture 34 in the upper wall 30 of the catch compartment 24. The back plate 40 is also provided with means to locate it over the catch compartment. In the illustrated embodiment these means comprise holes 46 which receive mounting screws 48 shown in FIG. 2. These screws also extend through holes 50 in the finger recesses 32 so that, in the illustrated embodiment, the means to mount the lock and the means to locate the back plate 40 over the catch compartment 20 are combined.

Figure 2:
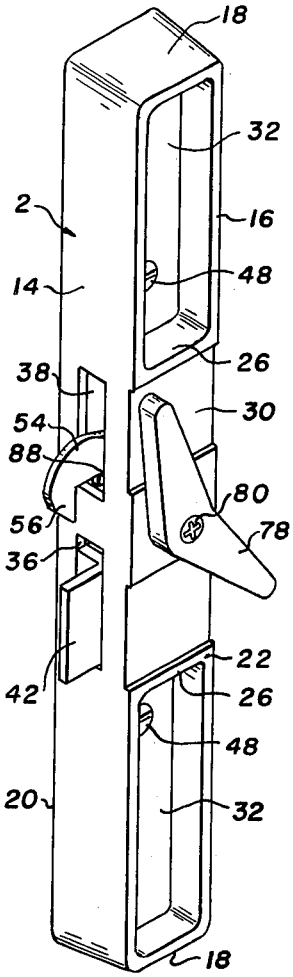
FIG. 2 is a perspective view of the lock of FIG. 1.
Figure 3:
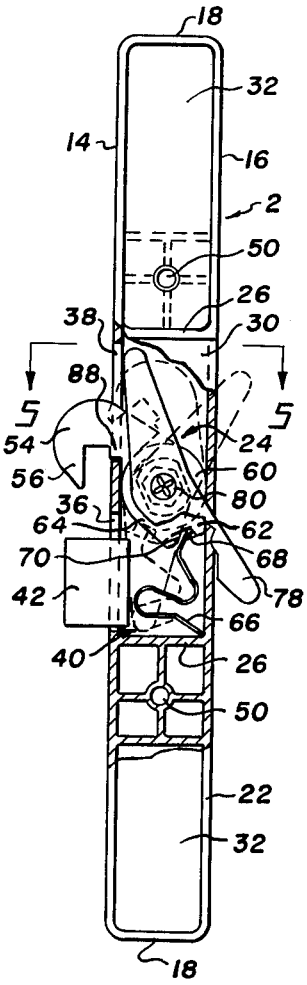
FIG. 3 is a plan view of the lock of FIG. 1.
Figure 4:
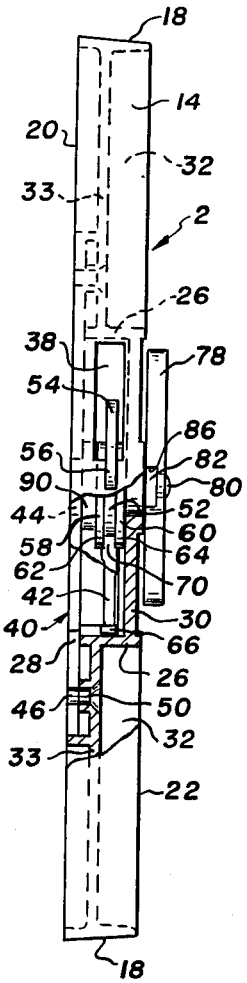
FIG. 4 is a side elevation of the lock of FIG. 1.
Figure 6:
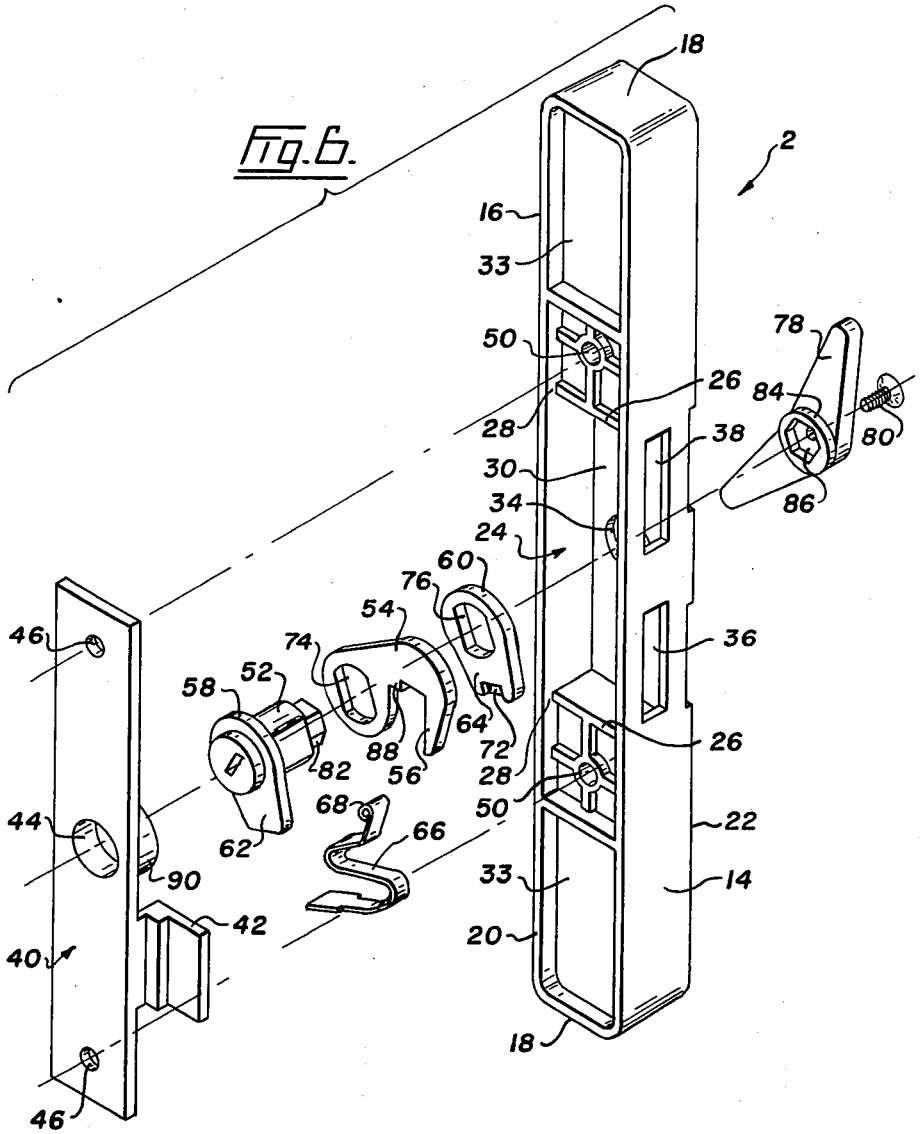
FIG. 6 is an exploded view of the lock illustrated in FIGS. 1 to 5.

As best illustrated in FIG. 6, there is a hub 52 journalled at one end in the aperture 44 in the back plate 40 and, at the other end, in the aperture 34 in the upper wall 30 of the catch compartment 24. A catch 54 is mounted on the hub 52. The catch 54 is formed with a hook 56 at its end remote from the hub 52. In the locked position for the lock the hook 56 projects through the second aperture 38 in the first side wall 14 - as best illustrated in FIGS. 2 and 3. The hub is provided with a first spacer 58 and a second spacer 60 which locate the hub 52 and the catch 54 between the upper wall 30 of the catch compartment 24 and the back plate 40. The spacer 58 is formed integrally with the hub 52 but it should be noted that it need not be.

Catch 54 is reciprocable with the hub 52 between the locked position, in which the hook 56 projects through the second aperture 38 in the first side wall 14, and an unlocked position, in which the hook 56 is substantially wholly within the catch compartment 24.

The lock can be provided with means to restrict the extent of reciprocable movement of the catch 54. In the illustrated embodiment the means to restrict the extent of the movement comprise a lug 62 formed integrally with the spacer 58 and the lug 64 formed integrally with the spacer 60. The sides of the lugs 62 and 64 are so shaped that they abut the inside of the first side wall 14 and the second side wall 16 of the elongate body and thus control the distance through which the hub 52, the catch 54, and the hook 56 can reciprocate.

The lock has means tending to maintain the catch 54 in the position, locked or unlocked, to which it has been moved last. In the illustrated embodiment, the means comprises a leaf spring 66 positioned within the catch compartment 24 and engaging the catch 54 at one end of the spring. The other end of the spring 66 is adapted to abut the junction of the cross wall 26 and the second side wall 16 (as best shown in FIG. 3) to locate the spring 66. In the illustrated embodiment the leaf spring 56 has a toggle 68 at one of its ends that engages in a cavity 70 (see FIG. 3) formed between the lugs 62 and 64. The cavity 70 in the illustrated embodiment, is formed by a recess (not shown) in lug 62 of spacer 58 and a recess 72 in the lug 64 of spacer 60. The recess in the lug 62, although not shown in FIG. 3, corresponds precisely to the recess 72 in the lug 64. The toggle 68 of the spring 66 engages in the cavity 70 formed by the recesses in the lugs 62 and 64.

In the embodiment of FIGS. 2 to 6 the spacer 58 is formed integrally with the hub 52. The catch 54 has an irregular opening 74 at its centre and the spacer 60 has an irregular opening 76 formed at its centre. These openings 74 and 76 correspond in shape to the hub 52 and, because that shape is irregular, the catch 54 and the spacer 60 are unable to move pivotally relative to the hub 52.

The lock has a handle 78, fixed relative to the hub 52, and mounted on that end of the hub 52 journalled in the aperture 34 in the upper wall 30 of the catch compartment 24. The handle is mounted by a screw 80 which engages in a threaded hole in the hub 52. The handle 78 permits rotation of the hub 52 and thus, of course, of the catch 54 and hook 56. In the illustrated embodiment the handle 78 is fixed relative to the hub 52 by the shaft being formed with a polygonal extension 82. The handle 78 is formed with a post 84 having a polygonal cavity 86 which engages with the polygonal extension 82 of the hub 52.

A number of variations are possible in the embodiment of the invention illustrated in FIGS. 1 to 6. For example, it is clearly possible that the catch 54, hub 52 and hook 56 be formed integrally. Furthermore, the means to locate the catch laterally, that is spacers 58 and 60, can be formed integrally with the catch 54, hub 52 and hook 56.

In addition to the illustrated means of restricting the extent of reciprocable movement of the catch, bosses can be formed on the catch 54. Indeed the embodiment of FIGS. 1 to 6 shows one boss 88 that, by contacting an edge of the second aperture 38, restricts the extent of the lock position. A second boss may also be formed on the back of the catch 54 to contact the inside of the second side wall 16 in the catch compartment 24 and thus restrict the extent of the unlock position for the catch. Of course, it is also not necessary to form a boss on the back of the hook 54. The back of the hook itself may contact the inside of the second wall 16.

The use of cavities such as 72 to engage with the toggle 68 of the leaf spring 66 is not essential. A shaft could be inserted through the lugs 62 and 64 to engage with the toggle 68.

Spacer 58 is shown formed integrally with the hub 52. However, it need not be so formed. It can also be formed in a manner similar to that illustrated for the spacer 60.

It is also possible that one spacer 58 or 60 is sufficient to locate the catch 54 laterally. This is particularly so where the aperture 44 in the back plate 40 has a wall 90 projecting from it. In the embodiment of the invention illustrated in FIGS. 2 to 6 the wall 90 is shown as merely a means of ensuring that the shaft 52 need not project through the back plate 44 and possibly be damaged. However, in certain embodiments of the invention, the wall 90 can be extended to abut the catch 54 and thus replace the spacer 58.

In addition to the illustrated means of mounting the handle 78 in FIGS. 2 to 6, the handle can be mounted by bolt 80 but fixed relative to the shaft 52 by means other than the polygonal cavity 86. For example a pin can be located non-axially in the handle 78 to be received in a recess in the end of the hub 52. The non-axial position of the pin will prevent substantial relative movement between the handle 78 and the hub 52.

Figure 7:
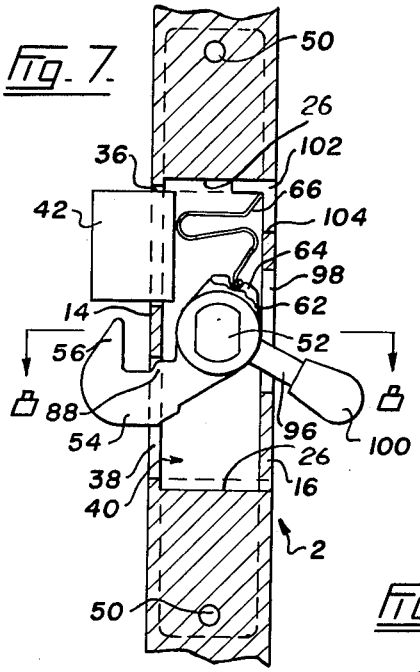
FIG. 7 is a sectional detail of a further embodiment of the invention.
Figure 8:
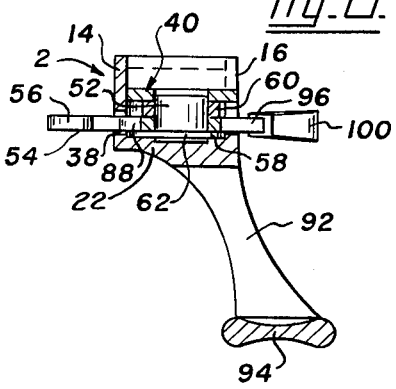
FIG. 8 is a section along the line 8—8 in FIG. 7.
Figure 9:
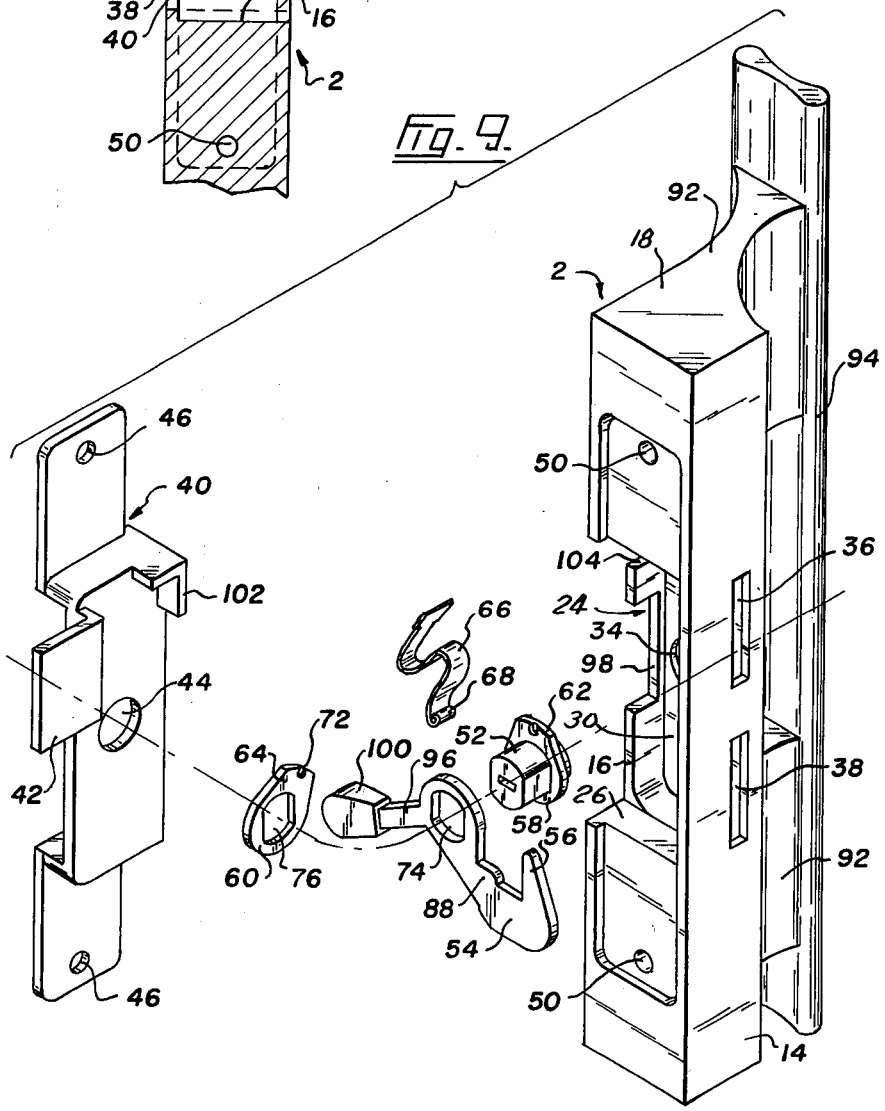
FIG. 9 is an exploded view of the lock shown in FIGS. 7 and 8.

The embodiment of the invention shown in FIGS. 7, 8 and 9 follows the same general concept as the embodiment illustrated in FIGS. 1 to 6. Accordingly, similar reference numerals have been used for similar parts. It is not believed that a further discussion of these components is necessary in discussing FIGS. 7 to 9. Similarly the above variations apply although, of course, the means of mounting the handle shown in FIGS. 2 to 6 is not applicable to the embodiment of FIGS. 7 to 9.

The embodiment of FIGS. 7 to 9 differs in that the lock 2 is formed with flanges 92 that extend from that side of the lock remote from the back plate 40 in a direction away from the back plate 40. A handle 94 is then attached to these flanges, for example by screws or it may be moulded integral with flange 92.

Further, the embodiment of FIGS. 7 to 9 has a catch 54 that is formed with a lever 96 that extends outwardly from the hub 62 through an opening 98 formed in the second side wall 16. The formation of the lever 96 is perhaps best shown in FIG. 9 and its extension through the opening 98 is best shown in FIG. 7. As indicated in FIG. 7, the lock position for the catch 56 is simply selected by moving the lever 96 downwardly. The unlock position is selected by moving the lever 96 upwardly. In the illustrated embodiment lever 96 is provided with a cap 100 to facilitate operation of the lever 96.

The back plate 40 illustrated in FIGS. 7 to 9 is shaped to increase its rigidity. Furthermore, projection 102 engages in an opening 104 in the second side wall 16 to facilitate location of the back plate.

The locks of the present invention are cheap to produce in comparison with prior locks of comparable strength and rigidity. This is so even though the elongate body, handle 78 and spacers 58 and 60 are preferably injection molded from polycarbonate resin. Generally the remaining parts of the lock may be die cast from aluminum or its alloys. The spring 66 is of spring steel.

We claim:

1. A lock for a slidable door comprising:

a elongated body having first and second side walls, a first end wall and a second end wall, the side walls and end walls defining a door-contacting base and a top, a catch compartment formed integrally in the elongated body by: (a) cross walls spaced from the end walls and joining the first and second side walls and (b) an upper wall adjacent the top of the elongate body, and a door handle for opening or closing the door;

a back plate to close the catch compartment;

a catch opening in a first side wall of the catch compartment;

a pivotable hub borne by aligned bearing means in the back plate and the catch compartment;

a catch mounted on the hub and reciprocable with the hub between a lock position in which the catch projects through said catch opening and an unlock position in which the catch is within said catch compartment;

means to permit selection of the lock or unlock position of the catch, and means to maintain the catch in the selected position.

2. A lock as claimed in claim 1 provided with an anti-lift device for preventing the lifting of the door when the door is closed and formed integrally with the back plate and extending through an opening in said first sdie wall in the catch compartment.

3. A lock as claimed in claim 1 in which flanges extend from that side of the lock remote from the back plate in a direction away from the back plate; and the door handle being attached to said flanges.

4. A lock as claimed in claim 3 in which the means to permit selection of the lock or unlocked position is a lever extending from the hub and through an opening in a second side wall of the catch compartment.

5. A lock as claimed in claim 1 having spacers to locate the hub laterally, the spacers being positioned on each side of the hub and being adapted to resist rotation relative to the hub;

lugs extending from each spacer;

a recess formed in the lugs, remote from the spacers, that co-operate to form a cavity;

a leaf spring having a toggle at one of its ends engaged in the cavity, the other end of the leaf spring abutting a wall of the catch compartment.

6. A lock as claimed in claim 5 in which one spacer is formed integrally with the hub, adjacent one end of the hub, sufficient of the hub projecting beyond the spacer to form a journal for the hub.

7. A lock as claimed in claim 1, wherein the door handle comprises at least one finger recess defined by the area between at least one cross wall, at least one end wall and the side walls, wherein said hub is journalled in a substantially circular aperture in the upper wall of the catch compartment and a substantially circular aperture in the back plate axially aligned with the aperture in the upper wall of the catch compartment, and wherein the means to permit selection of the lock or unlocked position comprises a lock handle fixed relative to the hub and mounted on that end of the hub journalled in the opening in the upper wall of the catch compartment to permit rotation of the hub and thus of the catch, said locking including:

an anti-lift plate for preventing the lifting of the door when closed, the lift plate being integral with the back plate and extending from the back plate through a further opening in the first side wall of the catch compartment.

8. A lock as claimed in claim 7 in which the lock handle is mounted by a bolt engaged in a threaded hole in the hub and in which a pin is arranged non-axially in the lock handle and the hub to prevent substantial relative movement between the lock handle and the hub.

9. A lock as claimed in claim 7 in which the lock handle is mounted by a bolt engaged in a hole in the hub and in which the hub has a polyegonal extension at the end that is journalled in the aperture at the end that is journalled in the aperture in the upper wall of the catch compartment, the lock handle being formed with a post having a polyegonal cavity to engage the polygonal extension of the hub to prevent substantial relative movement between the lock handle and the hub.

10. A lock as claimed in claim 1, wherein the elongated body is made of a suitable resin such as polycarbonate resin.

* * * * *